United States Patent [19]

Labelle

[11] Patent Number: 4,497,357

Date of Patent: Feb. 5, 1985

[54] SECTIONAL FOLDING CLOSURE

[75] Inventor: Henri M. R. Labelle, Cornwall, Canada

[73] Assignee: Martinray Industries Ltd., Cornwall, Canada

[21] Appl. No.: 193,719

[22] Filed: Oct. 3, 1980

Related U.S. Application Data

[63] Continuation of Ser. No. 960,247, Nov. 13, 1978.

[51] Int. Cl.[3] ..... E0D5 15/26

[52] U.S. Cl. ..... 160/199; 160/183

[58] Field of Search ..... 160/183, 199, 206, 345

[56] References Cited

U.S. PATENT DOCUMENTS

| | | | |
|---|---|---|---|
| 3,090,072 | 5/1963 | Fridolph | 160/345 |
| 3,359,594 | 12/1967 | Pastoor | 160/199 |
| 3,405,756 | 10/1968 | Harris | 160/183 |
| 3,654,982 | 4/1972 | Labelle | 160/199 |
| 3,901,302 | 8/1975 | Dagenais | 160/183 |

*Primary Examiner*—Peter M. Caun

*Attorney, Agent, or Firm*—Charles E. Brown

[57] ABSTRACT

A folding closure assembly for closing an opening. The assembly includes a track installed along the top of the opening, and a folding closure unit made up of a plurality of folding closure sections. Each closure section comprises a plurality of closure panels pivotably connected together. Each section is separately mounted on the track to be movably suspended therefrom. Means are provided on each side edge of the sections for joining the mounted sections together to form the folding closure unit.

The invention also covers the method of installing the folding closure assembly.

8 Claims, 10 Drawing Figures

SECTIONAL FOLDING CLOSURE

This is a continuation of application Ser. No. 960,247 filed Nov. 13, 1978.

BACKGROUND OF THE INVENTION

1. Field of the Invention

This invention is directed toward a folding closure assembly.

2. Description of the Prior Art

Folding closure assemblies are well known. They comprise a folding closure unit mounted within a frame and they are usually used to close the front of shops or stores located in malls. When a shop is open for business, the folding closure unit of the assembly is folded up and stored to one side of the shop's entrance. When the shop is closed, the closure unit is unfolded to extend across the shop entrance to close off the shop from the mall.

The folding closure unit can close the entrance opening from top to bottom or from one side to the other. The present invention is directed to the latter type of closure. The side-to-side type of folding closure unit is suspended from rollers or wheels riding on a track which extends across the top of the opening. The closure comprises a plurality of panels pivotably connected to each other along their adjacent vertical edges by suitable hinge connections. When the store entrance is open, the panels are folded against each other in accordian or zig-zag fashion to one side of the entrance opening. When the entrance is closed, the panels extend across the entrance in nearly aligned relationship.

The known folding closure unit has been factory assembled, and shipped to the installation site in one piece. At the installation site, the entrance opening of the shop is framed and a track is installed at the top of the opening. A section of the track is then removed and the entire folding closure unit, in its folded-up position, is lifted up into the break in the track to thread its rollers onto the remainder of the track so as to suspend the closure unit from the track. The removed track section is then replaced.

The above described installation method is however quite difficult to carry out, particularly where the folding closure unit is wide, extending across the entire width of a shop. A wide folding closure unit is extremely heavy, bulky and awkward to handle.

More importantly, if any portion of the installed folding closure unit becomes damaged after installation, the entire closure unit must be removed to repair it. This again is a difficult, awkward procedure.

SUMMARY OF THE INVENTION

It is the purpose of the present invention to provide an improved folding closure assembly which minimizes the above disadvantages. In accordance with the present invention there is provided a folding closure assembly having a folding closure unit made in sections. The folding closure sections can be individually installed on the track when installing the closure. The sections are much easier to handle than an entire closure unit. Once installed, on the track, the sections are joined together to form a full, closure unit. Installation is fast and simple. Another advantage in making the closure unit from sections easily installed and joined together is that if the closure unit is damaged, only the damaged section need be replaced thus reducing repair and maintainence costs.

In accordance with the present invention there is provided a folding closure assembly having a folding closure unit made from a plurality of folding closure sections. Means are provided on the sides of the sections for use in quickly and easily joining the sections together after they have been individually installed in order to form a single closure unit.

The invention is particularly directed toward a folding closure assembly for closing an opening. The folding closure assembly has a folding closure unit comprising a plurality of closure sections, each closure section comprising a plurality of panels pivotably joined together. Means are provided on each section for use in suspending each section in the opening. Means are also provided for joining the sections together at their adjacent side edges when suspended in the opening.

The folding closure assembly includes track means adapted to be mounted at the top of the opening. The sections are movably suspended from the track means by their suspending means. The track means includes a removable section of use in individually mounting the sections on the track means.

The means for joining the sections together comprises a first member at one side edge of each section, and a second member at the other side edge of each section, and first member on one section joining with the second member on an adjacent section.

The joining means also includes fastening means for: fastening the joined sets of first and second joining members together on the interior side of the closure.

The invention is also particularly directed toward a method for installing the folding closure assembly in an opening which method comprises the steps of installing track means along the top of the opening, removing a section of the track, mounting a plurality of folding closure sections, one at a time, on the remaining track, form the location of the removed track section, replacing the removed track section, and joining the mounted folding closure sections together to form a folding closure unit.

BRIEF DESCRIPTION OF THE DRAWINGS

The invention will now be described in detail having reference to the accompanying drawings in which.

DESCRIPTION OF THE PREFERRED EMBODIMENTS

Figure 1:
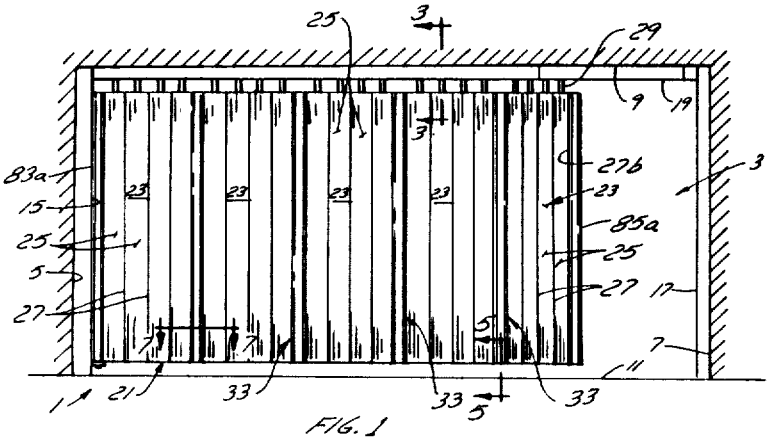
FIG. 1 is a front elevation view of the closure assembly with the folding closure partly closing an entrance opening.
Figure 2:
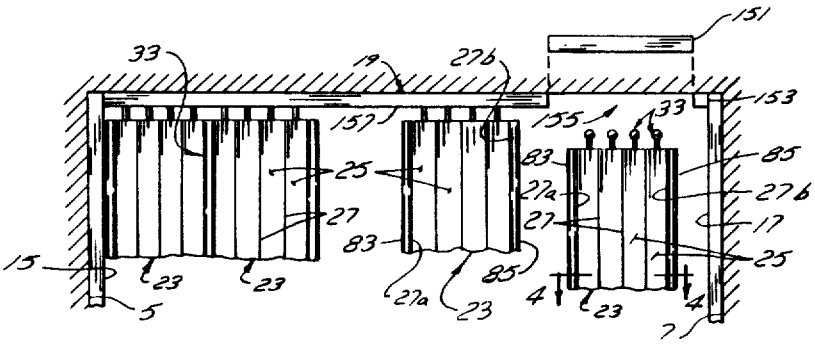
FIG. 2 is a front elevation view showing installation of the folding closure.

The folding closure assembly 1 of the present invention is designed to close an opening 3 as shown in FIGS. 1 and 2. The opening 3 is usually rectangular in shape and is defined by vertical side edges 5, 7; a horizontal top edge 9 extending between the tops of the side edges 5, 7; and a floor 11. The opening 3 usually forms the entrance to a store or shop.

The folding closure assembly 1 has side posts 15, 17 fastened to the side edges 5, 7 respectively of the opening 3. A track 19 is fastened to the top edge 9 of the opening 3, extending between the side posts 15, 17.

The folding closure assembly 1 includes a folding closure 21 mounted in the opening 3. The folding closure 21 is suspended from the track 19 in the opening 3 as will be described. The folding closure 21 is made up of a plurality of folding sections 23. Each folding section 23, in turn, is made up of a plurality of narrow, elongated panels 25. Adjacent panels 25 in each section are joined together along their long sides by hinges 27.

Figure 3:
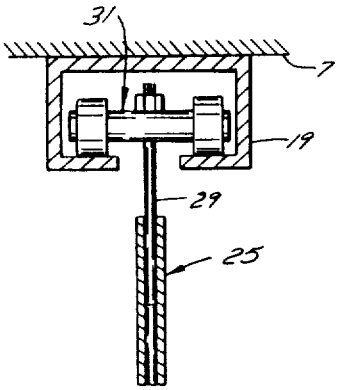
FIG. 3 is a detail cross-section view of a panel hanger taken along line 3—3 in FIG. 1.

A hanger 59 extends upwardly from the top center of each panel 25 as shown in FIG. 3. The hanger rotatably connects each panel 25 to a roller assembly 31 running on the track 19, so as to suspend each panel 25 in each folding section 23 from the track.

Connecting means 33 are provided for connecting the folding sections 23 together, end-to-end in series, to form the folding closure 21 as will be described.

Figure 4:
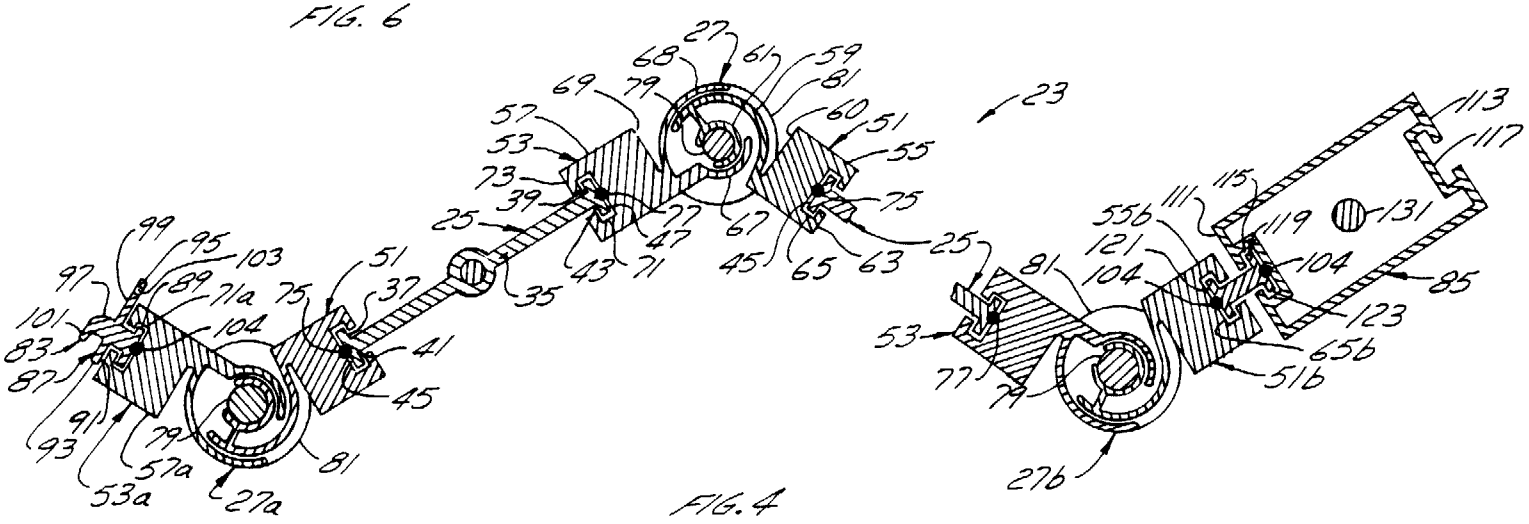
FIG. 4 is a cross-section view through one folding section used in the closure taken along line 4—4 in FIG. 2.

In more detail, as shown in FIG. 4, each panel 25 comprises a narrow, elongated slat-like member 35 having narrow transverse flanges 37, 39 on its long edges 41, 43. The flanges 37, 39 are centered with respect to slat member 35, and provide the panel 25 with a T-shaped cross-section at each long side 45, 47 of the panel. The slat member 35 and flanges 37, 39 are extruded in one piece.

Each hinge 27, as shown in FIG. 4 for joining adjacent panels 25 together, comprises a first male hinge member 51 and a second female hinge member 53. The male hinge member 51 is fixed to one long side 45 of a panel 25 and the female hinge member 53 is fixed to the other long side 47 of an adjacent panel 25. The hinge members 51, 53 are extruded lengths and have base sections 55, 57 respectively. Male hinge member 51 has a part-circular hinge arm 59 projecting from one side 60 of its base section 55. A part-circular pintle 61 is attached to arm 59 near its outer end. The other side 63 of the base section 55 has a T-shaped slot 65 therein. Female hinge member 53 has first and second part-circular arms 67, 68 projecting from one side 69 of the base section 57. Arm 68 has a bigger radius and is longer than arm 67. The arms 67, 68 face each other. A T-shaped slot 71 is provided in the other side 73 of the base section 57.

The male hinge member 51 of each hinge 27 is mounted on the side 45 of each panel 25 by sliding flange 37 on panel 25 into the T-shaped slot 65 in the base 55 of the hinge member 51. Suitable fastening means, such as a screw 75 inserted upwardly from the bottom of the panel 25 and threaded part-way into base 55, and part-way into flange 37, fix the male hinge member 51 to panel 25. The female hinge member 53 of each hinge 27 is similarly mounted on the side 47 of each panel 25 by sliding flange 39 on panel 25 into the T-shaped slot 71 in the base 57 of the hinge member 53. Suitable fastening means, such as a screw 77, similar to screw 75, is inserted upwardly and threaded part-way into base 57, and part-way into flange 39, to fix the female hinge member 53 to panel 25.

Figure 5:
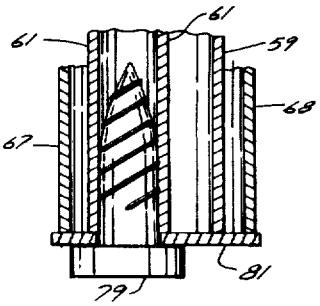
FIG. 5 is a detail cross-section view taken along line 5—5 in FIG. 1.
Figure 6:
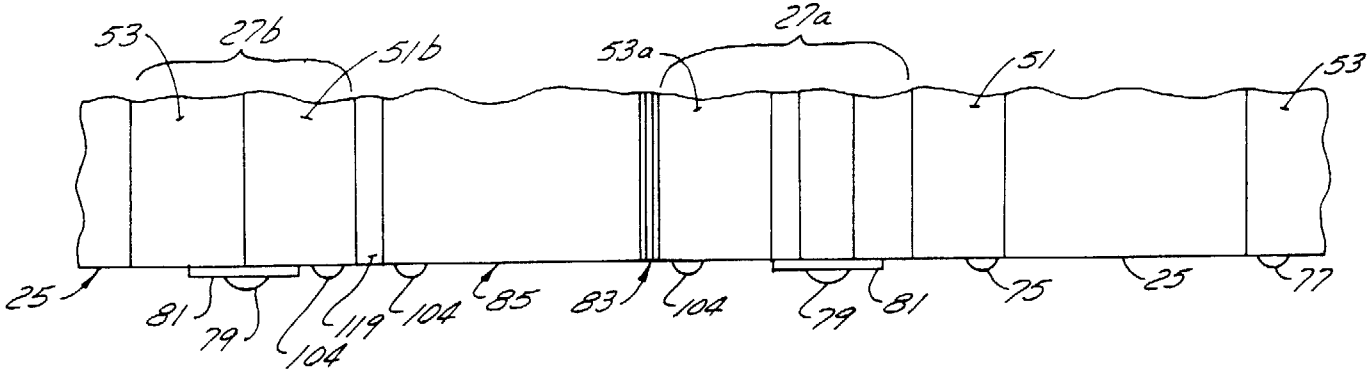
FIG. 6 is a detail bottom side view where one section is attached to another.

The panels 25 in each folding section 23 are joined together by longitudinally sliding the male hinge member 51 on each panel, into the female hinge member 53 on an adjacent panel 25 to form hinge 27 joining the panels together as shown in FIG. 4. More particularly, the pintle 61 on male hinge member 51 is rotatably mounted within the part-circular arm 67 on female hinge member 53. Arm 67 in turn is rotatably mounted within part-circular arm 59 on male hinge member 51, which arm in turn is rotatably mounted within part-circular arm 68 on female hinge member 53. A screw 79 is threaded upwardly into the bottom end of pintle 61 on the male hinge member 51. This is more clearly shown in FIGS. 5 and 6. A washer 81 carried by screw 79 supports the bottom ends of hinge arms 67, 68 on female hinge member 53 and thus prevents the male hinge member 51 from sliding out of the female hinge member 53.

Each folding section 23 includes a hinge **27*a* at one end, and a hinge 27*b* at its other end as shown in FIG. 4. Hinge 27*a* at the one end includes the male hinge member 51 on the panel 25 at that end, and a further female hinge member 53*a* interconnected with the male hinge member 51. Hinge 27*b* at the other end of the folding section 23 includes the female hinge member 53 on the panel 25 at that other end, and a further male hinge member 51*b* interconnected with the female hinge member 53. Screw 79 and washer 81 arrangements connect hinge members 51, 53*a*, and hinge member 51*b*, 53** together.

The connecting means 33 joining the folding sections 23 together to form a folding closure 21 includes a connector strip 83 on one end of each folding section 23, and a connector post 85 on the other end of each section 23. The connector strip 83, as shown in FIG. 4, has a flat body portion 87. A T-shaped flange 89 extends from one side 91 of the body 87 and is located nearer one edge 93 of the body than the other edge 95. A connecting flange 97 extends from the other side 99 of the body 87. The connecting flange 97 is located opposite the T-shaped flange 89. The outer portion 101 of the flange 97 is bent toward edge 93. A row of fastening holes 103 can be provided through body 87, the row extending parallel to, and adjacent the one edge 95. The connector strip 83 is connected to the female hinge member **53*a* of the hinge 27*a* at the one end of each folding section 23 by sliding its T-shaped flange 89 in the T-shaped slot 71*a* on the base 57*a* of the female hinge member 53*a*. A screw 104, similar to screws 75, 77, fastens strip 83 to the female hinge member 53*a***.

The connector post 85 is preferably tubular with a rectangular cross-section. Located in the center of each narrow end wall 111, 113 of the post 85 is a T-shaped slot 115, 117 respectively as shown in FIG. 4. An I-shaped connector 119 connects the post 85 to the male hinge member **51*b* of the hinge 27*b* on the other end of each section 23. One side 121 of connector 119 fits snugly into the T-shaped slot 65*b* on the base 55*b* of the male hinge member 51*b*. The other side 123 of connector 119 fits snugly into the slot 115 in the side wall 111 of post 85. Screw fasteners 104 connect connector 119 to both the male hinge member 51*b* and post 85**.

A hanger rod 131 can extend upwardly from the center of the top of each post 85. The upper end of the hanger rod 131 can be connected to a roller assembly similar to roller assemblies 31 running on the track 19.

It will be seen that each folding section 23 is made up of a plurality of panels 25, connected together by hinges 27. An additional hinge 27*a*, 27*b* is provided at each end of the section. A connector strip 83 is fixed to the female hinge member 53*a* of the hinge 27*a* at one end, and a connecting post 85 is fixed to the male hinge member 51*b* of the hinge 27*b* at the other end.

Figure 7:
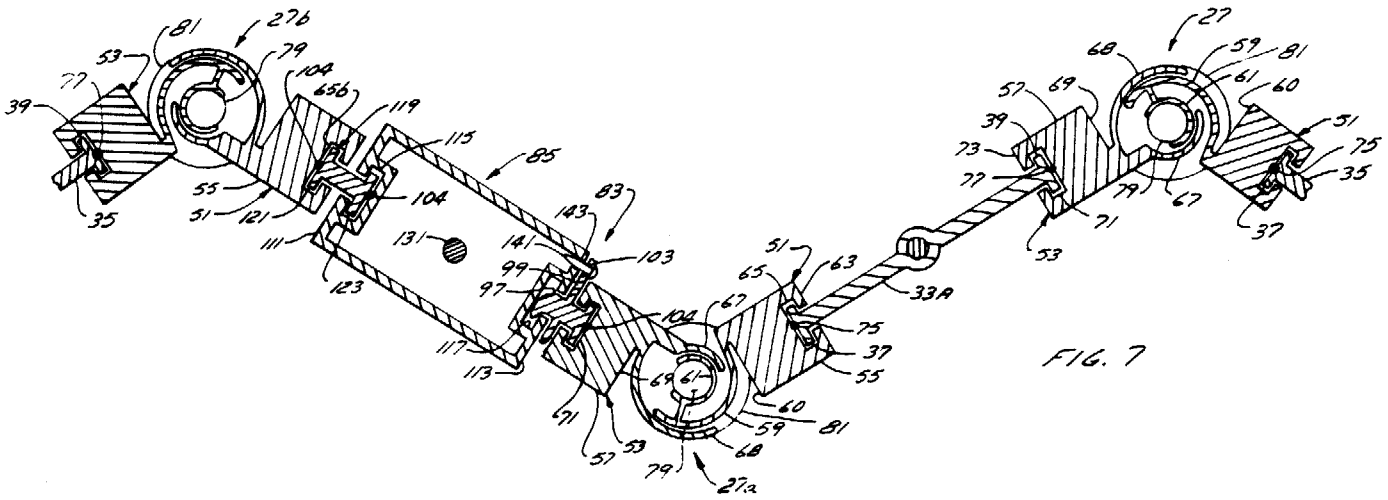
FIG. 7 is a detail cross-section view taken along line 7—7 of FIG. 1.

Adjacent sections 23 are joined together to form folding closure 21 by inserting the bent connecting flange 97 on the connector strip 83 of one section into the slot 117 on the post 85 of the other section as shown in FIG. 7. The side 99 of the strip 83 lies flush against the end wall 113 of the post 85. Suitable fasteners, such as screws 141, are then used to fasten strip 83 to the post 85, the screws 141 passing through holes 103 in strip 83 and into end wall 113, or into holes 143 in the end wall 113, of post 85.

The above construction allows the folding closure 21 to be installed in sections 23 out in the field, thus simplifying installation. To facilitate installation, the track 19 is provided with a removable section 151 near one end 153 thereof as shown in FIG. 2. Removal of section 151 provides an installation break 155 in the track 19. The closure 21 is installed by lifting the sections 23 one at a time up into the break 155 and sliding their roller assemblies 49 onto the remaining section 157 of the track 19 so that they are each suspended from the track. The sections 23 are then joined together by inserting the flange 97 on the connecting strip 83 on each section 23 into the slot 117 in the post 85 on each adjacent section 23. Alignment can be checked at this time. If it is satisfactory, the sections are permanently joined together using the screws 141. The removable track section 151 is then replaced, to provide a full track 19 across the opening. It should be noted that the screws 141 joining the sections 23 together are located on the interior store side of the closure rather than on the exterior mall side.

The closure 21 is fixed to one side post 15 as shown in FIG. 1, by means of a connecting strip 83*a* fixed to the post 15 via its flange 99 and screws 141. The T-shaped flange 89 on strip 83*a* is mounted in the slot 71*a* on the base 57*a* of the female hinge element 53*a* on the end of the first section 23 of the closure 21. A post 85*a* is provided on the free end of the closure 21 connected to hinge 27*b* by a connector 119. Latch means in post 85*a* permit the unfolded closure 21 to lock with post 17 on the other side of the opening 3 to close it.

Figure 8:
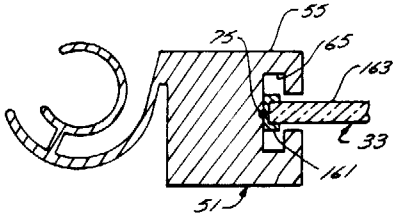
FIG. 8 is a detail cross-section view showing another type of panel construction in the closure.

The panels 25 in each section 23 can comprise metal slats. Alternatively, as shown in FIG. 8, the panels 25 can comprise an outer metal frame 161 surrounding a glass sheet 163. The frame 161 holds the glass and is mounted by suitable fastening means within the slots 65, 71 of the hinge members 51, 53.

Figure 10:
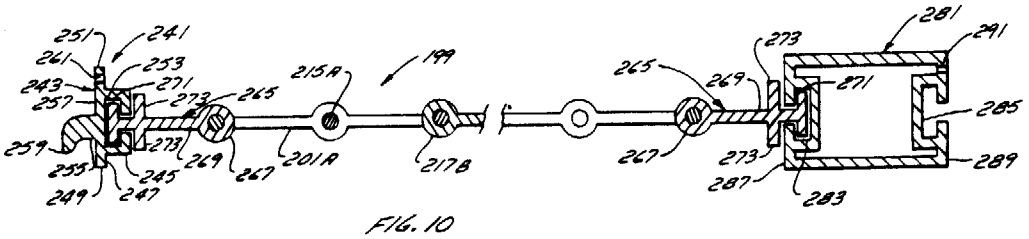
FIG. 10 is a cross-section view, taken along line 10—10 of FIG. 9.
Figure 9:
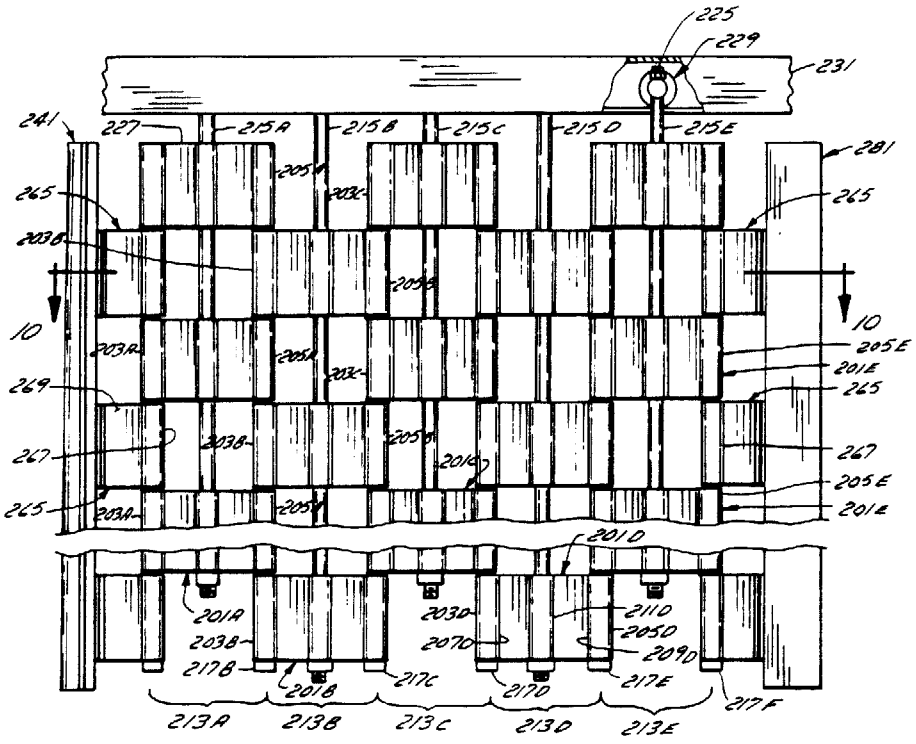
FIG. 9 is a front elevation view, similar to FIG. 1, showing a modified closure.

While a closed type of folding closure has been described, the concept of forming a folding closure unit from folding closure sections can be applied to grill-type closures as well. As shown in FIGS. 9 and 10, each closure section 199 can have a plurality of generally square panels 201. Each panel 201 has tubular hinge members 203, 205 fastened to each vertical side 207, 209 respectively of the panel. Each panel 201 also has a tubular portion 211 in the center between the hinge members 203, 205 and extending parallel to them. The panels 201 are arranged in vertical rows 213A, 213B, 213C, etc. with the panels in each row spaced apart by the panels in adjacent rows.

The panels in each row are mounted on a hanger rod 215 which passes freely through the central tubular portion 211 of each panel in the row. Pivot rods 217 are provided where adjacent panel rows meet. For example, where panel row 213A meets with panel row 213B, the tubular members 205A on panels 201A are aligned with the tubular members 203B on panels 201B. Pivot rod 217B passes through the aligned, alternating tubular members 205A, 203B to pivotably join the panels 201A, 201B together. Similarly pivot rod 217C joins panels 201A, 201C together by their aligned, alternating tubular members 205B, 203C. The pivot rods 217 have suitable means (not shown) at their bottom end for supporting the panels thereon. The hanger rods 215 also have suitable means (not shown) at their bottom end for supporting the panels of each row thereon. The upper ends 225 of the hanger rods 215 extend above the top edge 227 of the panel section and are fastened to roller assemblies 229 riding on a track 231.

A connecting strip 241, similar to connecting strip 85, is fixed to one side edge of the panel section 199. The strip 241 has a narrow, main body portion 243 with a shoulder 245 on one side 247 of the body 243 and closer to one edge 249 of the body than the other edge 251. A T-shaped slot 253 is formed in the center of shoulder 245. A flange 255 projects outwardly from the other side 257 of strip 241, opposite slot 253. The outer portion 259 of the flange 255 is bent. A row of location holes 261 can be provided in strip body 243 adjacent edge 251.

Tubular spacers 265 are fastened to strip 241. Each spacer 265 has a tubular portion 267 equal in length to the depth of a panel 201. A short connecting arm 269 extends radially from tubular portion 267. A T-shaped portion 271 is provided at the end of arm 269. One, and preferably two, flanges 273 extend transversely from arm 269, next to T-shaped portion 271.

Each spacer 265 is fitted between two adjacent tubular members 203A on adjacent panels 201A in the first panel row 213A. Pivot rod 217A passes through the aligned, alternating tubular portions 267 and members 203A. The flanges 273 are fastened, by suitable means, to the face of the shoulder 245 on the connecting strip 241 with the T-shaped portion 271 snugly fitting in slot 253.

A post 281, similar to post 85 is fixed to the other side edge of the section 199. The post 281 is tubular with a rectangular cross-section and has a T-shaped slot 283, 285 formed in the center of each end wall 287, 289 respectively.

Tubular spacers 265 are fastened in spaced-apart relation to post 281 along one end wall 287, with the T-shaped portion 271 snugly fitting into slot 283. The spacers 265 are fastened via their flanges 273, by suitable means, to the post. The tubular portions 267 alternate with the tubular members on the panels 201E in the last panel row 213E and the last pivot rod 217F joins the aligned tubular portions 267 and members 205E together.

Thus a folding closure section 199 is provided, of the grill type, having a connecting strip 241 along one edge and connecting post 281 along the other edge. These sections 199 are mounted individually on a track 231 and then joined serially together with the flange 255 on the connecting strip 241 of each section inserted into the T-shaped slot 285 on the post 281 of the adjacent section. The strip 241 is then fastened to the post with fasteners attached in the aligned holes 261 on the strip and holes 291 on post 281.

I claim:

1. A folding closure assembly for closing an opening having; a plurality of closure sections; each closure section comprising a plurality of panels pivotably joined together; means on each closure section for use in suspending said closure section in the opening; a first joining member on one side edge of each section; a second joining member on the other side edge of each section; the first joining member on one section joining with the second joining member on an adjacent section after the sections are suspended in the opening, and fastening means for fastening the joined joining members together on the interior side of the folding closure.

2. A folding closure assembly as claimed in claim 1 including track means adapted to be mounted along the top of the opening, the suspending means on each closure section cooperating with the track means to movably suspend the closure sections from the track means, the track means including a removable section for use in mounting the sections on the track means to be movably suspended therefrom.

3. A folding closure assembly as claimed in claim 1 wherein the first joining member comprises a connecting strip having means on one side, near one edge, for use in joining it to the side edge of a closure section, a flange projecting from the other side of the strip opposite the joining means, the outer end of the flange bent; the second joining member comprising a post, means on one side wall of the post for use in connecting said post to the side edge of a closure section, and a centrally located T-slot in the other side wall of the post for receiving the flange when the strip is abutted against the side wall.

4. A folding closure assembly as claimed in claim 3 wherein the joining means on the connecting strip consists of a T-shaped flange.

5. A folding closure assembly as claimed in claim 3 wherein the joining means on the connecting strip consists of a T-shaped slot.

6. A folding closure assembly as claimed in claim 1 wherein each panel has a narrow, elongated shape, the length of each panel generally equal to the height of the closure, hinge means on each side edge of each panel, the hinge means on adjacent panels cooperating to pivotably join the panels together, and a hanger member projecting up from the center of the top end of each panel to form part of the suspending means.

7. A folding closure assembly as claimed in claim 6 wherein each panel has a frame mounted between the hinge means, and glass mounted within the frame.

8. A folding closure assembly as claimed in claim 1 wherein each panel has a generally square shape, hinge means on each side edge of each panel, hinge rods having a length substantially equal to the height of the closure, the panels hingedly mounted on the rods in staggered relation to form a grille.

* * * * *